United States Patent [19]

Tahara

[11] Patent Number: 4,901,435

[45] Date of Patent: Feb. 20, 1990

[54] CUTTER LID OF RISE-AND-ROTATION TYPE FOR CONTAINER

[75] Inventor: Yoshimasa Tahara, Toyama, Japan

[73] Assignees: Ajinomoto Inc., Tokyo; Shirouma Plastics Kogyo Inc., Toyama, both of Japan

[21] Appl. No.: 274,482

[22] Filed: Nov. 22, 1988

[30] Foreign Application Priority Data

Nov. 24, 1987 [JP] Japan ..... 62-295897

[51] Int. Cl.[4] ..... B67B 7/00

[52] U.S. Cl. ..... 30/2; 220/267; 222/83

[58] Field of Search ..... 30/2, 1.5; 222/83.5, 222/83, 81, 541; 220/267, 269, 220

[56] References Cited

U.S. PATENT DOCUMENTS 3,463,347 8/1969 Kerr ..... 220/48
3,871,352 3/1975 Irland et al. ..... 222/83

FOREIGN PATENT DOCUMENTS 61-44988 12/1986 Japan .
181650 6/1922 United Kingdom .
558610 1/1944 United Kingdom .

*Primary Examiner*—Douglas D. Watts
*Attorney, Agent, or Firm*—Oblon, Spivak, McClelland, Maier & Neustadt

[57] ABSTRACT

Here is disclosed a cutter lid for a container hermetically filled with fluid content such as liquid food, e.g., stew, or granular food, e.g., table salt, characterized by that there is provided a cutter member including a knife edge adapted to cut into a top cover of the container as a foldable and rotatable grip is folded upwards. Upon raising the cutter member with the grip held, the knife edge of said cutter member cuts into the top cover of the container and rotation of the grip opens the top cover. In contrast with the pull-open type cutter lid of prior art, there is produced no force causing the container to be vertically moved and therefore the top cover of the container can be opened without any splashing of the fluid content. Furthermore, the rotatable disc provided on the upper side of the top cover to rotate the cutter member serves also as reinforcing means and decorative means for the top cover.

9 Claims, 4 Drawing Sheets

CUTTER LID OF RISE-AND-ROTATION TYPE FOR CONTAINER

BACKGROUND OF THE INVENTION

The present invention relates to a cutter lid for a container hermetically filled particularly with fluid content such as liquid food, e.g., stew or gravy sauce, or granular goods, e.g., powder cheese or table salt.

The container hermetically filled particularly with liquid or other fluid content of so-called pull-open type is well known from, for example, the disclosure of Japanese Utility Model No. 1986-44988, according to which the cover thereof is opened by pulling the pull-tab attached to a part of the cover. In this case, the cover is previously provided along the cutting-off line with the portion less resistant than the rest in the form of the scored portion so that the substantial portion of the cover may be easily torn off by a pulling force and thereby a piece of the cover may be removed to open the container.

However, strength of such containers against stacking and falling during their distribution from the manufacturer to the consumers is inverse to their openability, so said strength should be sacrificed if much importance is attached to said openability and said openability should be sacrificed if much importance is attached to said strength. Thus, the prior art has always had to make a compromise. Accordingly, even the portion of the cover less resistant than the rest has conventionally had to maintain a considerably high strength and, for women or children, not only a correspondingly high pulling force has been necessary to open the container but also uneasy posture has been required to pull the tab with the container maintained upright so to prevent the content filling the container from being spattered around. Otherwise, the cover of this type might be suddenly opened at the pulling force reaching a certain level and often an excessive force might shake the container vertically, resulting in that the environment is stained with splash of the content. Moreover, when it is desired to heat the content together with the container within an electronic oven, an inconvenience has been encountered such that the container is opened the contents are before heated and then a separately provided overcap must be put on the container in order to avoid boiling over of the content. Furthermore, the cover of this type has the scored portion which is normally exposed to accumulation of dust and easily subjected to the problem of tampering such as piercing by an injector needle.

SUMMARY OF THE INVENTION

In view of the problems as have been set forth above, the present invention provides a cutter lid of rise-and-rotation type for a container characterized by that a top cover of the container is provided with a cutter member including at least one knife edge adapted to cut into the top cover as a rotatable grip is folded to rise. The present invention further provides a cutter lid of rise-and-rotation type for a container characterized by that a top cover of the container is provided on its upper side with cutter means in the form of a rotatable disc a part of which is foldable to rise with respect to the rest so as to form a grip which is, in turn, provided with at least one knife edge adapted to swing around the folding line and thereby to cut into the top cover as said grip is raised.

With the cutter lid of this invention, the grip may be held, thereby the cutter member may be raised to thrush the knife edge into the scored portion of the top cover, and subsequently the grip may be rotated to open the top cover at least during a complete rotation of said grip. In this process, a speed at which the cutter member is rotated can be adjusted by the consumer as he or she desires and a direction of torque exerted on the cutter member is horizontal with respect to the container held upright. With a consequence, there is produced no force intending to shake the container vertically and there is no risk that the fluid content might be splashed out of the container.

In addition, the rotatable disc provided on the upper side of the top cover serves not only as reinforcing means but also as decorative means for the top cover, improving a desired strength during distribution of the product and protecting the scored portion. As a result, no accumulation of dust occurs and a tamperproofness is achieved, for example, against piercing by an injector needle. Further, the content can be heated directly together with the container within the electronic oven without requiring any type of overcap so far as the cutter member is raised before heated so as to form an opening in the scored portion and thereby to provide an outlet for vapour. Finally, the rotatable disc may be partially raised not only to provide the grip for the cutter member but also to make the rotatable disc serve as means rotatably supporting the cutter member including the knife edge.

EMBODIMENTS

Figure 1:
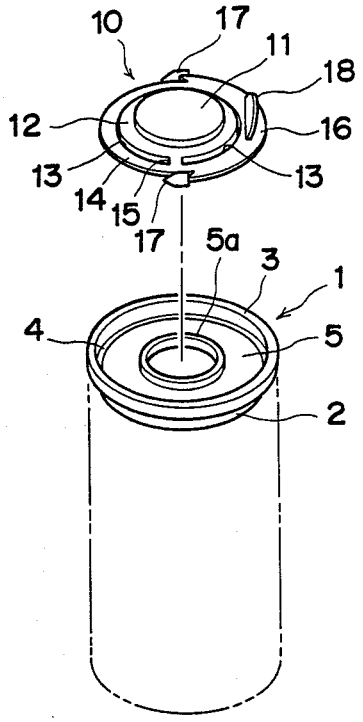
FIG. 1 is a disassembled perspective view showing an embodiment of the cutter lid constructed in accordance with the present invention.
Figure 2:
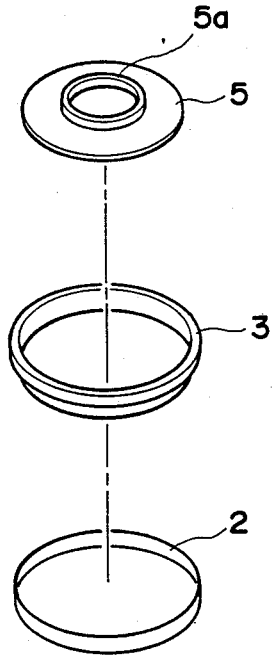
FIG. 2 is a disassembled perspective view of an important part of the container's top cover integrally molded but showing as disassembled for convenience of illustration.
Figure 3:
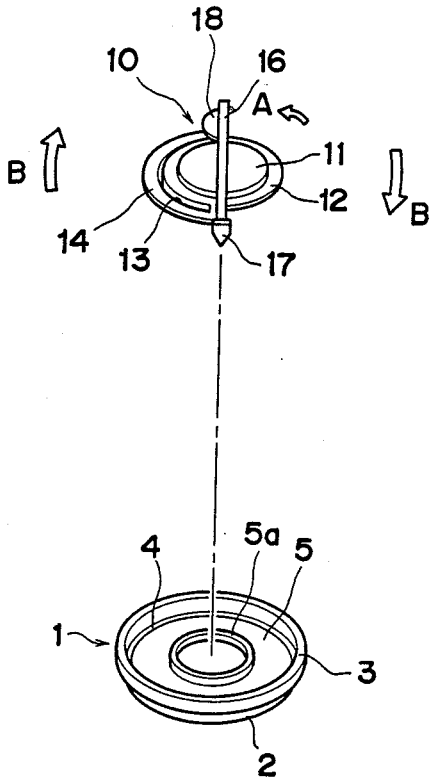
FIG. 3 is a disassembled perspective view illustrating a manner in which the cutter lid of the invention operates.
Figure 5:
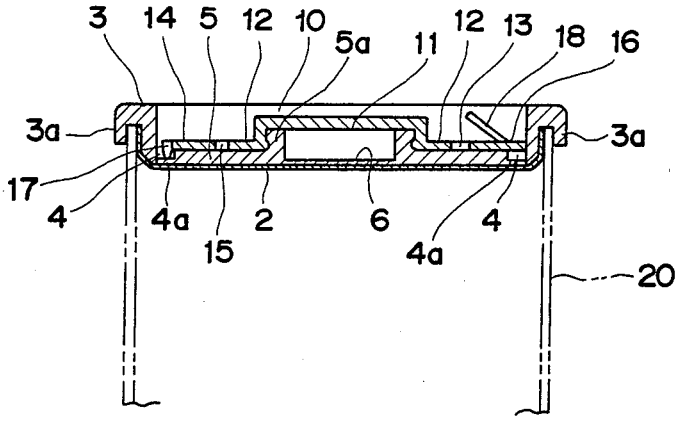
FIG. 5 is an elevational view showing the important part of the cutter lid partially in section.

The present invention will be more apparent from the following description of the embodiments thereof in reference with the accompanying drawing. Reference numeral 1 designates a top cover of a container serving also as one component of a cutter lid constructed according to the present invention, said top cover 1 comprising, as seen in FIG. 2, a metallic foil layer 2 made of aluminum or like and forming a bottom layer, a ring-like portion 3 of plastic to be fit within a peripheral rising portion 3 of said metallic foil layer 2, and a rotation supporting portion 5 made of plastic adapted to be fit against the inner periphery of said ring-like portion 3, leaving a circumferential groove 4. The ring-like portion 3 includes, as seen in FIG. 5, a frame-like portion 3*a* along which the ring-like portion 3 is secured by heat sealing means such as high frequency welding to a body 20 of can, for example, paper can lined with metallic foil, and the rotation supporting portion 5 is centrally provided with an integral bearing 5*a* adapted for rotatably supporting a cutter means in the form of a rotatable disc as will be described later more in detail. The ring-like portion 2 and the rotation supporting portion 5 are integrally molded by so-called insert molding of plastic with said metallic foil layer 2 inserted thereinto to form a plastic layer of the top cover 1. A bottom of the groove may comprise said metallic foil layer 2 which is exposed, or coated with a thin plastic layer 4*a* as seen in FIG. 5. It should be understood here that the groove 4 constitutes a scored portion.

Reference numeral 10 designates said rotatable disc made of plastic provided on the upper side of the top cover 1. Specifically, the rotatable disc 10 has a central recess 11 adapted for rotatably fitting on said bearing 5*a* so as to be rotatable with respect to the top cover 1 without slipping off therefrom. The rotatable disc 10 comprises a flange-like portion 12 of said recess 11 and an outer peripheral portion 14 connected by a separation groove 13 to said flange-like portion 12. A pair of bridges 15 connecting the flange-like portion 12 to the outer peripheral portion 14 symmetrically lie on a diametrical line passing the rotation center of the rotatable disc 10 or on a straight line intersecting the diametrical line. One half of the outer peripheral portion 14 extending at one side of extensions of said pair of bridges 15 is configured not to reach said groove 4 while the other half of the outer peripheral portion 14 extending at the opposite side of extensions of said pair of bridges 15 is configured to each said groove 4. The half of the outer peripheral portion 14 configured to reach the groove 4 can be folded upwards along said pair of bridges 15 to form a grip for a cutter member 16 serving as another component of the cutter lid according to the present invention and provided at locations on the extensions of the respective bridges 15 which are opposed to said groove 4 with knife edges 17 of the cutter member 16 constructed in accordance with the present invention. Each of the knife edges 17 is adapted to swing around the folding line extending along said pair of bridges 15 and thereby to pierce or cut into said metallic foil layer 2. The knife edges 17 may be made of plastic molded integrally with the cutter member 16 or separately molded metallic knife edges may be secured to the cutter member 16. It suffices to provide at least one such knife edge 17. Reference numeral 18 designates a pull tab with which the cutter member 16 is raised.

Figure 4:
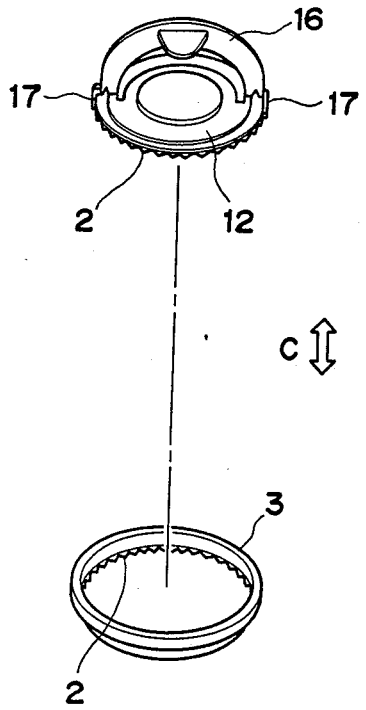
FIG. 4 is also a disassembled perspective view illustrating a manner in which the cutter lid of the invention operates.

With the embodiment as has been described above, the knife edges 17 cut into the metallic foil layer 2 forming the bottom of the groove 4 of the top cover 1 as the cutter member 16 is raised in the direction as indicated by an arrow A. Then, the grip of the cutter member 16 is held and the rotatable disc 10 is rotated in the direction as indicated by an arrow B. In response to this, the knife edges 17 circumferentially travel, continuing to cut the metallic foil layer 2 along the groove 4 until said metallic foil layer 2 no longer connects the ring-like portion 3 of the top cover 1 with the rotation supporting portion 5, as seen in FIG. 4, so that the rotatable disc 10 may be lifted with respect to the ring-like portion 3 integral with the container to remove the rotation supporting portion 5 together with said rotatable disc 10 and thereby to open the top cover.

Figure 6:
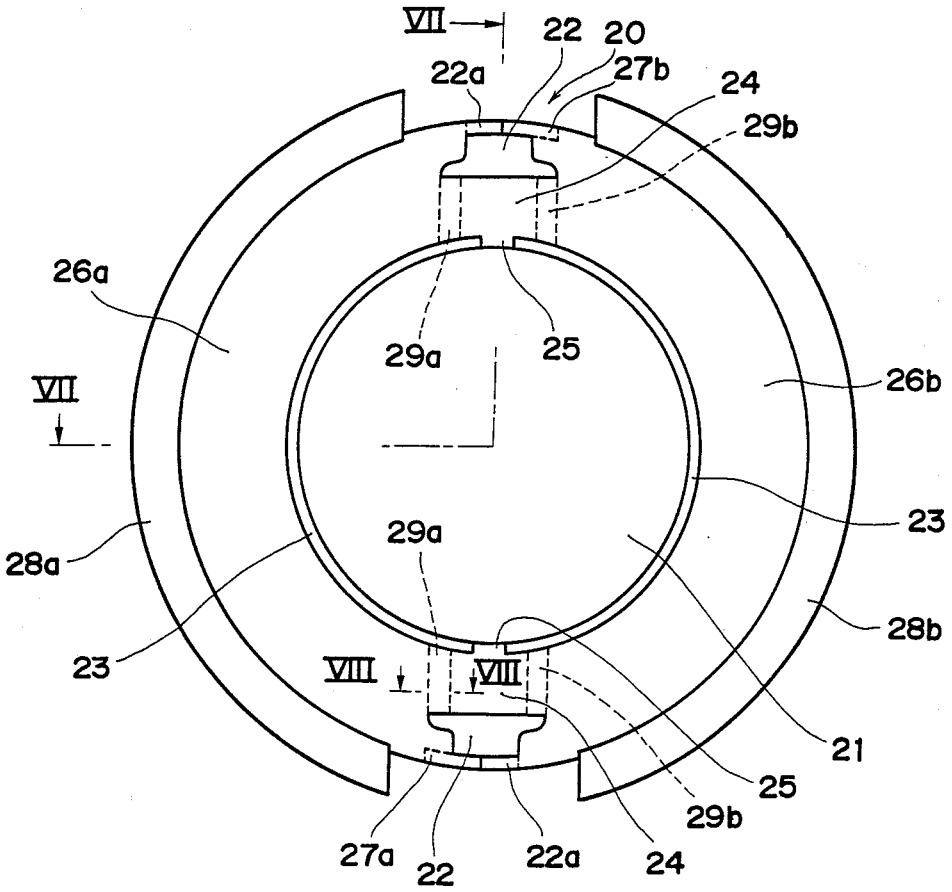
FIG. 6 is a plan view showing an important part in another embodiment of the cutter lid constructed in accordance with the present invention.
Figure 7:
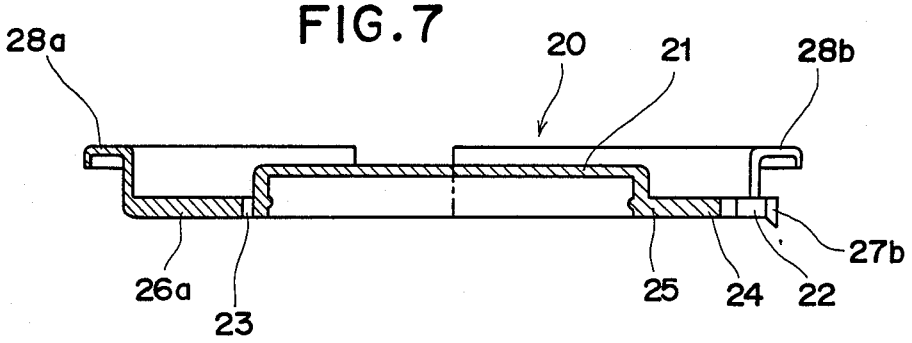
FIG. 7 is a sectional view taken along a line VII—VII in FIG. 6.
Figure 8:
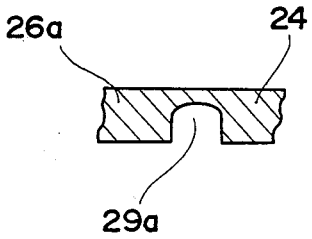
FIG. 8 is a sectional view taken along a line VIII—VIII in FIG. 6.

FIGS. 6 and 7 illustrate a rotatable disc 20 in another embodiment of the present invention, which is rotatably mounted on the top cover 1 of the container in the same manner as the rotatable disc 10 in the previously mentioned embodiment.

Specifically, the rotatable disc 20 has a central recess 21 adapted to be rotatably fit on the bearing 5*a* of said top cover 1. In contrast with the previously mentioned embodiment, the rotatable disc 20 in this embodiment includes no portion corresponding to said flange-like portion 12 and instead said recess 21 is continuous with a pair of bridges 25, leaving separation grooves 23, said bridges 25 being directly continuous with an outer peripheral portion 24. The pair of bridges 25 symmetrically lie on a diametrical line passing a rotation center of the rotatable disc 20 and are continuous with the outer peripheral portion 24. The rotatable disc 20 is provided at locations along its outer periphery defined by associated cutaway openings 22 formed in the outer peripheral portion 24 in opposition to the respective bridges 25 with knife edges 27*a*, 27*b*. As viewed in FIG. 6, the left hand knife edge 27*a* with respect to the diametrical line dividing the rotatable disc 20 into left and right halves is provided on the left half of the outer peripheral portion while the right hand knife edge 27*b* is provided on the right half of the outer peripheral portion, and arc-shaped portions respectively extending from the opposite sides and being continuous with the associated knife edges are implemented as tearable thin connectors 22*a*. The outer peripheral portion 24 is provided along both sides of the associated bridge 25 with a pair of folding grooves 29*a*, 29*b* uniformly spaced from eash other extending from the associated separation groove 23 to the associated cutaway opening 22. Referring to FIG. 6, a semicircular left half of the outer peripheral portion is folded upwards along the folding groove 29*a* to form a first cutter member 26*a* and a semicircular right half of the outer peripheral portion is folded upwards along the folding line 29*b* to form a second cutter member 26*b*. Said knife edges 27*a*, 27*b* are respectively molded integrally with the first and second cutter members 26*a*, 26*b* and respectively folded integrally with said cutter members 26*a*, 26*b* along said folding grooves 29*a*, 29*b*, respectively, cutting into a bottom of the groove 4 provided in the top cover 1 of the container as the scored portion and thereby breaking said metallic layer 2. In this embodiment, the cutter members 26*a*, 26*b* are integrally provided along their outer peripheral edges with covering frames 28*a*, 28*b* adapted to be fit on and thereby to cover the ring-like portion 3 of the top cover 1. These covering frames 28*a*, 28*b* serve also as grip means to raise the respective cutter members 26*a*, 26*b* and therefore the pull tab 18 employed in the previous embodiment is unnecessary.

In this embodiment of the rotatable disc 20, the cutter members 26*a*, 26*b* having the respective covering frames 28*a*, 28*b* completely covering the groove 4 formed in the top cover 1 as the scored portion and, therefore, this embodiment is more preferable than the previous embodiment so far as the protective effect against accumulation of dust is concerned.

As will be apparent from the foregoing description, the cutter lid constructed in accordance with the present invention provides a significant improvement over the pull-open type cutter lid of prior art in that there is produced no force causing the container to be vertically moved and thus there occurs no splashing of the fluid content, because the knife edges cut into the top cover as the cutter members are raised with the grip means held, then the top cover is opened by at least one complete rotation of the cutter member assembly and during such process a speed at which the cutter members are rotrated can be adjusted by the individual consumer as he or she desires and the direction in which the torque exerted on the cutter members is horizontal with respect to the container maintained upright. Furthermore, the rotatable disc provided on the upper side of the top cover serves not only as reinforcing means but also as decorative means for the top cover and may be partially raised to form the grip and the rotation supporting means for the cutter member.

What is claimed is:

1. A rise-and-rotation type cutter lid for a container including a top cover of the container provided with a cutter member including at least one knife edge adapted to cut into the top cover as a rotatable grip is folded to rise, wherein the top cover is provided with a circumferential groove along which the knife edge cuts into for circumferentially cutting through the top cover.

2. A rise-and-rotation type cutter lid for a container, comprising:

a top cover for sealably closing a container; and cutter means rotatably mounted to said top cover, said cutter means including:

(a) gripping means pivotably connected to said cutter means, and (b) at least one cutter element mounted on said cutter means so as to move with the pivoting of said gripping means, wherein said gripping means are pivotable such that said at least one cutting element pierces said top cover during a pivoting of said gripping means, whereby subsequent rotation of said cutter means cuts said top cover.

3. A rise-and-rotation type cutter lid for a container including a top cover of the container provided with a cutter member including at least one knife edge adapted to cut into the top cover as a rotatable grip is folded to rise, wherein the top cover of the container comprises a metallic foil layer of aluminum and a plastic layer molded integrally with each other.

4. A rise-and-rotation type cutter lid for a container as recited in claim 3, wherein the top cover of the container is provided with a circumferential groove along which the knife edge cuts into and for circumferentially cutting through the top cover.

5. A rise-and-rotation type cutter lid for a container as recited in claim 2, wherein the top cover of the container is provided with a circumferential groove along which the knife edge cuts into for circumferentially cutting through the top cover.

6. A rise-and-rotation type cutter lid for a container as recited in claim 2, wherein the top cover of the container comprises a metallic foil layer of aluminium and a plastic layer molded integrally with each other.

7. The rise-and-rotation type cutter lid of claim 2, wherein said cutter means comprises a disc.

8. The rise-and-rotation type cutter lid of claim 2 or 7 wherein said gripping means comprise a semicircular half of the disc.

9. The rise-and-rotation type cutter lid of claim 7 wherein said at least one cutter element comprises at least two cutter elements.

* * * * *